US009226628B2

(12) United States Patent
Morrison, Jr.

(10) Patent No.: US 9,226,628 B2
(45) Date of Patent: Jan. 5, 2016

(54) FLUSHABLE SPOT CLEANER

(71) Applicant: Payton A. Morrison, Jr., Statesville, NC (US)

(72) Inventor: Payton A. Morrison, Jr., Statesville, NC (US)

( * ) Notice: Subject to any disclaimer, the term of this patent is extended or adjusted under 35 U.S.C. 154(b) by 0 days.

(21) Appl. No.: 13/715,074

(22) Filed: Dec. 14, 2012

(65) Prior Publication Data

US 2013/0152319 A1 Jun. 20, 2013

Related U.S. Application Data

(60) Provisional application No. 61/570,601, filed on Dec. 14, 2011.

(51) Int. Cl.
*A47K 11/10* (2006.01)

(52) U.S. Cl.
CPC ..... *A47K 11/10* (2013.01)

(58) Field of Classification Search
CPC ..... A47K 11/10; A47L 13/00; A46B 5/005
USPC ..... 15/144.4, 104.94, 160, 244.1, 172, 15/210.1
See application file for complete search history.

(56) References Cited

U.S. PATENT DOCUMENTS

| | | | | |
|---|---|---|---|---|
| 2,666,223 | A * | 1/1954 | Farrell | 15/210.1 |
| 5,470,653 | A | 11/1995 | Honeycutt et al. | |
| 5,471,697 | A | 12/1995 | Daconta | |
| 6,880,197 | B2 | 4/2005 | Katz et al. | |
| 7,127,768 | B2 | 10/2006 | Blum et al. | |
| 7,146,676 | B2 | 12/2006 | Kubes et al. | |
| 7,284,294 | B2 | 10/2007 | Kozakow | |
| 7,316,046 | B2 | 1/2008 | Michaels et al. | |
| 7,603,739 | B2 | 10/2009 | Minkler et al. | |
| 7,761,950 | B2 | 7/2010 | Konishi et al. | |
| 7,788,758 | B2 | 9/2010 | Konishi et al. | |
| 7,842,654 | B2 | 11/2010 | Sherry et al. | |
| 7,943,538 | B2 | 5/2011 | Konishi et al. | |
| 7,958,590 | B2 | 6/2011 | Trefethren et al. | |
| 8,230,543 | B2 * | 7/2012 | Shrier et al. | 15/145 |
| 2005/0139724 | A1 * | 6/2005 | Lear et al. | 242/610 |

FOREIGN PATENT DOCUMENTS

| | | | |
|---|---|---|---|
| EP | 0313495 | A1 * | 4/1989 |
| EP | 1166707 | A1 | 1/2002 |
| WO | WO 9604136 | A1 | 2/1996 |

* cited by examiner

*Primary Examiner* — Shay Karls
(74) *Attorney, Agent, or Firm* — Ronald L. Hofer

(57) ABSTRACT

A flushable tool for cleaning a toilet bowl has an elongated water soluble handle, one end of which carries a water soluble cleaning agent.

8 Claims, 2 Drawing Sheets

FLUSHABLE SPOT CLEANER

FIELD OF THE INVENTION

The present invention relates to cleaning tools. More specifically, the present invention relates to a biodegradable, water soluble spot cleaning tool especially useful for cleaning toilets.

BACKGROUND OF THE INVENTION

Cleaning is a task that has been with people for many centuries and it seems probable that people have searched for new and improved cleaning tools just about as long as they have been involved in cleaning processes. However, there remains a need for a new and improved cleaning tool particularly well adapted to cleaning toilets.

One cleaning task which is important for maintaining a healthy environment but nevertheless is disliked by many people is the task of cleaning a toilet. Even flushable toilets often require that someone clean urine and/or fecal matter from the toilet bowl, rim or seat. Of course, numerous toilet cleaning tools already exist for this purpose, Most tools consist of a durable handle with a brush or sponge part. Some tools include a durable handle with a flushable cleaning surface. The tools are usually used in conjunction with a cleaning chemical provided separately from the tool or incorporated into a sponge part of the tool. Chemical products are also available to help maintain a clean toilet between manual cleanings by incorporating chemicals into the toilet water.

Common cleaning tools are intended for use to thoroughly and completely clean the toilet. However, many times there is a need only for a spot cleaning of urine or fecal matter between thorough cleanings. Thus, there is a need for a toilet cleaning tool especially designed for use to quickly spot clean a toilet bowl, rim or seat. Just such a tool is provided in accordance with the present invention which provides a small, fully flushable cleaning unit which has been designed for use between complete toilet cleanings. The spot cleaning device or tool of this invention can be used to remove soiled spots as they are discovered on an otherwise clean toilet without the need to use the full accompaniment of the usual devices and chemicals. The tool of this invention can be made inexpensively and is inexpensive to use, thus facilitating its use as a spot cleaning device. Furthermore, the tool of the present invention is intended to be disposed immediately after use to eliminate any need to store a contaminated durable cleaning implement near the toilet.

Further understanding of the present invention will be had from the following disclosure and claims taken in conjunction with the accompanying drawings.

SUMMARY OF THE INVENTION

A flushable tool has an elongated water soluble handle, one end of which carries a water soluble cleaning agent.

BRIEF DESCRIPTION OF THE DRAWINGS

FIG. 9 is a perspective view of the cleaning tool of FIG. 8 showing it in a collapsed or coaxial configuration for carrying in a purse or the like.

DETAILED DESCRIPTION OF THE INVENTION

Figure 1:
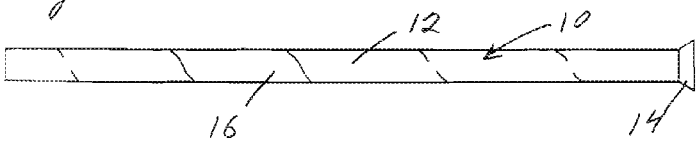
FIG. 1 is a side elevation view of a preferred embodiment of a flushable cleaning tool of the present invention.

Now referring to the drawings wherein identical reference numerals denote the same elements throughout the various views, FIGS. 1-5 illustrate a preferred embodiment of a flushable spot cleaning tool of the present invention which is generally indicated by the numeral 10. Spot cleaning tool 10 broadly comprises handle 12 and impregnated plug 14.

Handle 12 is a hollow tube having enough strength so that it will not bend when sufficient force is applied by the user during spot cleaning. Handle 10 is comprised of a suitable material such as a helical, rolled and formed, round, water soluble, biodegradable, coated card board tube with a coating 16 on its radially outward surface. Coating 16 can comprise any natural or synthetic material which provides temporary water resistant barrier to protect handle 12 for a predetermined amount of time. Materials and methods suitable for construction of handle 12 are commercially available and will be readily apparent to those skilled in the art.

Plug 14 is preferably impregnated with a suitable detergent and is preferably a water soluble, quilted, detergent impregnated, rolled material. Suitable materials and methods for making plug 14 are commercially available and will be readily apparent to those skilled in the art.

Figure 2:
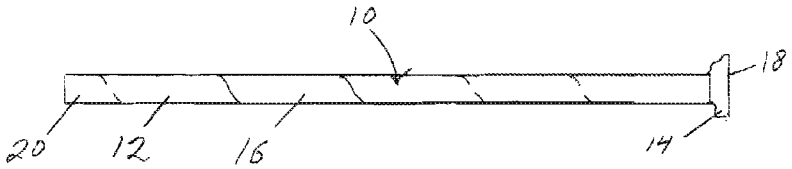
FIG. 2 is a perspective view of the tool of FIG. 1 with its detergent impregnated plug moistened with water.
Figure 3:
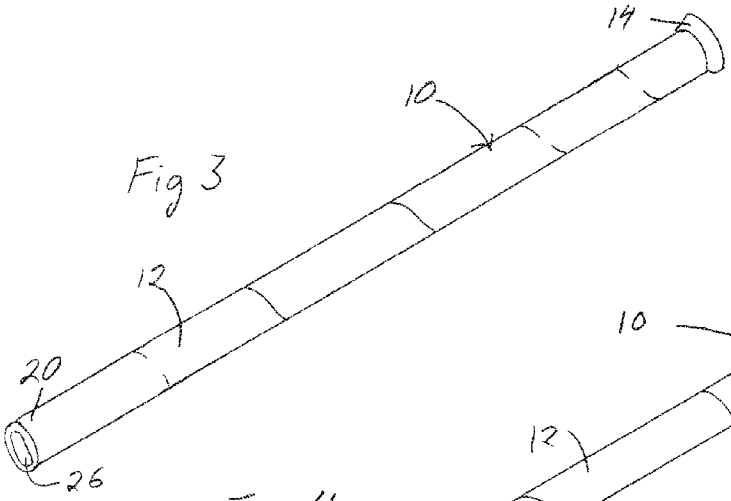
FIG. 3 is a perspective view of the handle of the tool of FIG. 1 depicting its hollow end.
Figure 4:
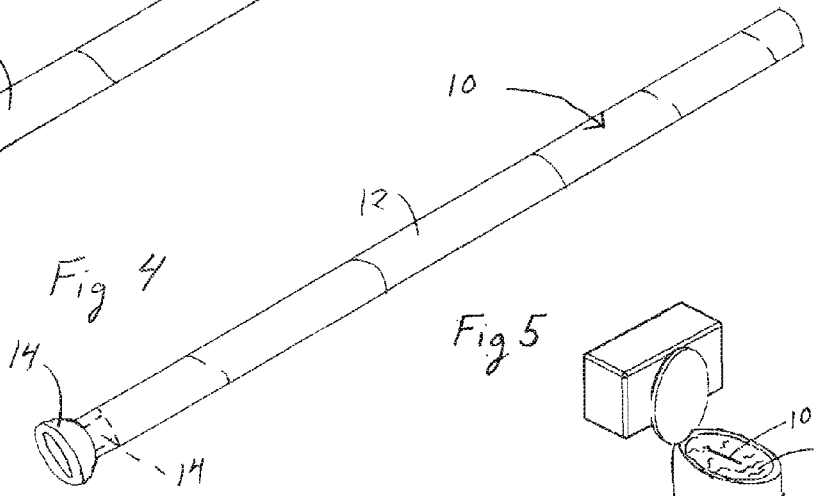
FIG. 4 is a perspective view of the plug end of the tool of FIG. 1.

Plug 14 is inserted into one end of tubular handle 12, as best illustrated in FIG. 4, at the time of manufacture to form a cleaning surface 18. Plug 14 has a portion that extends beyond or clear of the tubular handle 12. As illustrated in FIG. 2, plug 14 flares to a larger diameter, when moistened with water. Plug 14 thus will thereby prevent toilet water from immediately entering into the uncoated interior of tubular handle 12 or flowing therethrough during use of tool 10 or from dripping down the tubular handle 12 to its proximal end 20 if tool 10 is inverted. This feature is intended to provide sufficient time for cleaning without disintegration of handle 12 in water. This feature also reduces the risk of bacterial contact to the user of tool 10.

Figure 5:
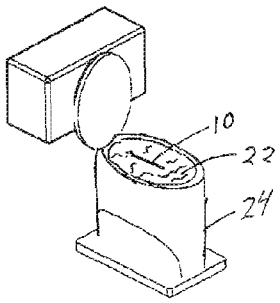
FIG. 5 is a perspective view of the tool of FIG. 1 illustrating its dissolution in toilet water.

After use and as illustrated in FIG. 5, cleaning tool 10 can be dropped into water 22 in toilet bowl 24 to allow water to enter through proximal end 20 of handle 12 to contact the uncoated interior 26 of handle 12 to immediately water saturate handle 12 and to promote quick disintegration of the tool 10 for trouble free flushing of the invention down toilet 24. The construction of the tubular handle 12 is helical roiled to further aid in water dissolving of tool 10 for ease of toilet flushing and rapid dissipation in sewer and septic systems.

Figure 6:
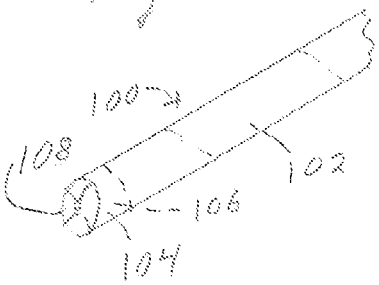
FIG. 6 is a perspective view, broken away, of an alternative preferred embodiment of the present invention having a detergent impregnated crimped tip.

Referring to FIG. 6, an alternative preferred embodiment of the present invention is shown and indicated generally by the numeral 100. Cleaning tool 100 comprises handle 102 which is generally analogous to handle 12 except that the cleaning or distal end 104 of handle 102 is crimped to enclose water soluble plug 106 which is analogous to plug 14 of cleaning tool 10. It is intended that the end portion 104 of handle 102 will not be protected from dissolution by a coating so that when dipped into water in the toilet bowl, crimps 108 as well as end portion 104 will dissolve to expose plug 106 to water in the bowl thereby releasing or exposing plug 106 for cleaning. The opposite end portion of handle 102 (not shown in the Figures) is open like that of end 20 of cleaning tool 10.

Figure 7:
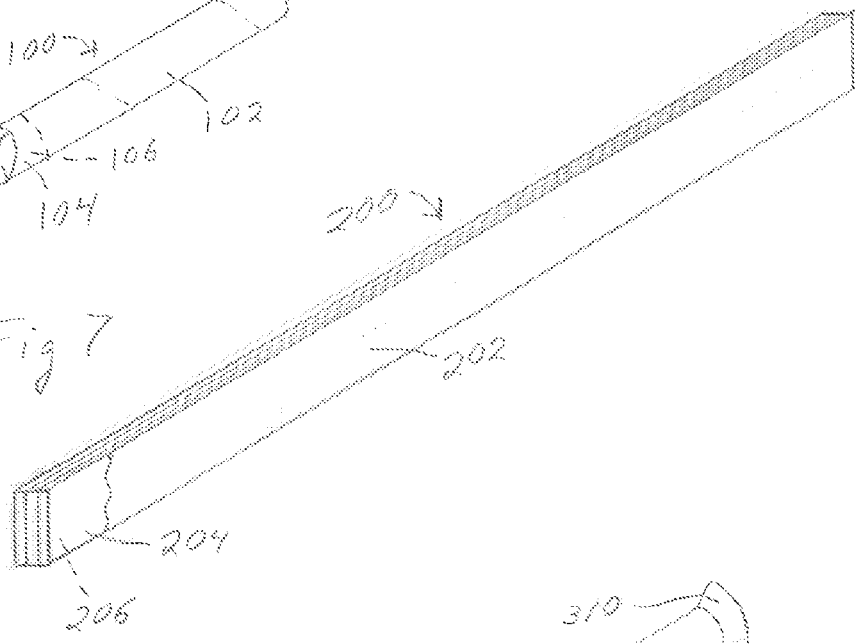
FIG. 7 is a perspective view of another alternative preferred embodiment of the present invention having a flat, laminated handle.

FIG. 7 illustrates yet another alternative preferred embodiment of the present invention indicated generally by the numeral 200. Cleaning tool 200 does not have a tubular handle but has an elongated handle 202 which is rectangular in cross section and is made up of layers of water soluble paper or cardboard in a laminated fashion. Of course, handle 202 must comprise a material that is selectively slow to dissolve in water or is coated by another material to provide such properties to handle 202 consistent with the purpose of this invention. Distal end 204 of handle 202 is impregnated with a detergent or other cleaning or disinfecting agent 206.

Figure 8:
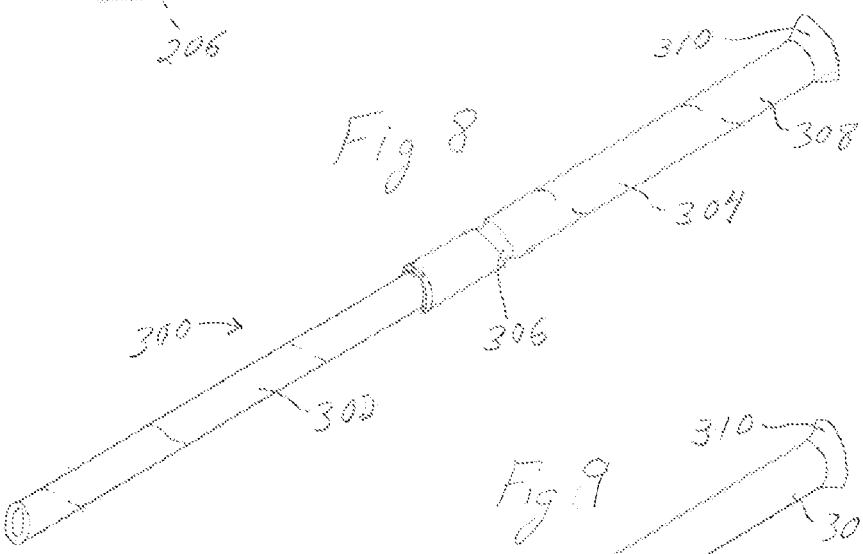
FIG. 8 is a perspective view of yet another preferred alternative embodiment of the present invention which has a telescoping handle.
Figure 9:
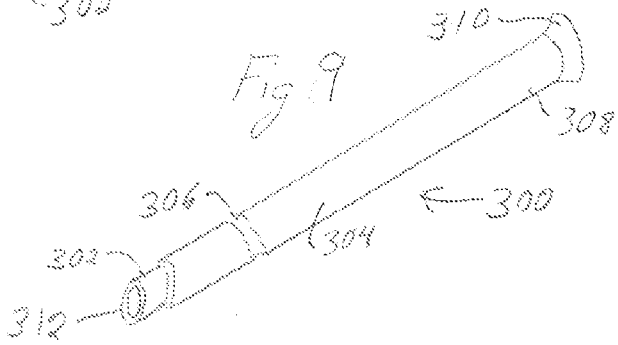

Now referring to FIGS. 8 and 9 another alternative preferred embodiment of this invention is shown and illustrated by the numeral 300. Cleaning tool 300 is particularly adapted for travel and has an adjustable length so that it can be telescoped to a short length for carrying in a purse or the like and then telescoped or lengthened for use. Thus, cleaning tool 300 has a proximal section 302 which is tubular and has a smaller diameter than distal section 304 such that proximal section 302 fits slidably coaxially within distal section 304. Also, distal section 304 is provided with indentations 306 which provide a corresponding ridge in the interior of section 304 which ridge snappingly fits into a cooperating indentation in the outside surface of section 302 to thereby selectively lock section 302 and section 304 in extended relationship for use as a cleaning tool. The distal end 308 of distal section 304 is provided with either a plug 310 analogous to plug 14 or end 308 can be crimped with crimps like crimps 108 of cleaning tool 100. Proximal end 312 of proximal section 302 is open like that of end 20 of cleaning tool 10.

The invention possesses numerous benefits over other spot and/or toilet cleaning devices, in particular the invention is made entirely of water soluble, biodegradable components of such a size and volume to make the apparatus completely flushable; moreover, the invention reduces the amount of landfill waste and bacterium in household trash receptacles.

While a preferred embodiment of the present invention is disclosed above, it will be appreciated that this invention is subject to variation and modification and it is intended that the invention will be limited only by the following claims.

What is claimed is:

1. A tool intended for use as a spot cleaner for a flushable toilet bowl, the tool having an elongated tubular handle made of a water soluble material and having a hollow interior and having a distal end and a proximal end, said distal end being plugged by a water resistant plug sufficient to prevent water from entering the hollow interior of the handle during its use and said proximal end being open to entry of water when said handle is submerged therein, said handle having a radially outwardly facing surface coated with a water resistant coating sufficient to protect said handle from disintegration during its use, and each of said handle and said plug being immediately flushable after being entirely submersed in water in said toilet bowl.

2. A tool as in claim 1, wherein said plug is impregnated with a detergent and is disposed at least partially within said distal end of said handle.

3. A tool as in claim 2, wherein said distal end is crimped to enclose said plug.

4. A tool as in claim 2, wherein said handle comprises two telescoping sections.

5. A tool as in claim 1, wherein said handle comprises a plurality of layers laminated together.

6. A tool as in claim 1, wherein said handle is comprised of water soluble helical rolled cardboard.

7. A tool intended for use as a spot cleaner for a flushable toilet bowl, the tool having an elongated helical rolled tubular cardboard handle made of a water soluble material, said handle having a hollow interior and a radially outwardly facing surface coated with a water resistant coating sufficient to protect said handle from disintegration during its use, said handle having a distal end plugged by a water resistant plug sufficient to prevent water from entering the hollow interior of the handle during its use extending beyond said handle and a proximal end which is open to entry of water when said handle is submerged therein, each of said handle and said plug being immediately flushable after being entirely submersed in water in said toilet bowl.

8. A tool as in claim 7 wherein said plug has a characteristic of expansion upon contact with water.

* * * * *